US005996828A

United States Patent [19]

Cheyn

[11] Patent Number: 5,996,828

[45] Date of Patent: Dec. 7, 1999

[54] CORNER ASSEMBLY FOR A BOX

[76] Inventor: Ruey Chyuan Cheyn, P.O. Box 63-99, Taichung, Taiwan, 406

[21] Appl. No.: 09/168,619

[22] Filed: Oct. 9, 1998

[51] Int. Cl.[6] ..... B65D 6/22

[52] U.S. Cl. ..... 220/4.33; 220/4.31

[58] Field of Search ..... 220/4.33, 4.31, 220/4.28, 7

[56] References Cited

U.S. PATENT DOCUMENTS

| | | | |
|---|---|---|---|
| 3,182,847 | 5/1965 | Fuller | 220/4.31 |
| 3,315,639 | 4/1967 | Close | 220/4.33 |
| 3,955,702 | 5/1976 | Lundy | 220/4.33 |
| 4,221,302 | 9/1980 | Kupersmit | 220/4.31 |
| 4,809,851 | 3/1989 | Oestreich, Jr. et al. | 220/4.33 |
| 4,828,132 | 5/1989 | Francis, Jr. et al. | 220/4.28 |
| 5,236,099 | 8/1993 | Fties et al. | 220/4.28 |
| 5,429,259 | 7/1995 | Robin | 220/4.33 |
| 5,558,242 | 9/1996 | Kuan | 220/4.33 |
| 5,711,444 | 1/1998 | Mgacham et al. | 220/4.33 |
| 5,720,403 | 2/1998 | Sawyer | 220/4.33 |
| 5,813,556 | 9/1998 | Onken | 220/4.33 |

*Primary Examiner*—Joseph M. Moy

[57] ABSTRACT

A box includes three or more plates each having one or more corner areas formed by two edges, and includes one or more couplers each having three pairs of latches, and includes three or more frames each having two pairs of panels for forming two grooves and for receiving the edges of the plates and for receiving the pairs of latches of the coupler. A securing device may secure the frames to the coupler for securing the plates together without additional tools and fasteners. Three or four frames may be secured to the couplers for securing two or more boxes together.

6 Claims, 4 Drawing Sheets

CORNER ASSEMBLY FOR A BOX

BACKGROUND OF THE INVENTION

1. Field of the Invention

The present invention relates to a box, and more particularly to a corner assembly for assembling the corner of the box.

2. Description of the Prior Art

Typical casings or boxes comprise a six surfaces and eight corners. The surfaces are secured together at the corners with fasteners or adhesive materials and thus the boxes may not be easily assembled. Additional tools or fasteners are required for assembling the boxes.

The present invention has arisen to mitigate and/or obviate the afore-described disadvantages of the conventional boxes.

SUMMARY OF THE INVENTION

The primary objective of the present invention is to provide a box having one or more corner assemblies for easily and quickly assembling the corners of the boxes.

In accordance with one aspect of the invention, there is provided a box comprising at least three plates each including at least one corner area defined by two edges thereof, at least one coupler including three pairs of latches, at least three frames each including two pairs of panels for defining two grooves and for receiving the edges of the plates and for receiving the pairs of latches of the coupler, and means for securing the frames to the coupler and to secure the plates together, such that the box may be easily and quickly secured and assembled together without additional tools and fasteners.

The latches of each pair of the latches of the coupler are perpendicular to each other. The latches of the coupler each includes two bars and a hook disposed between the bars, the pairs of panels of the frames each includes an opening for engaging with the hooks and for securing the frames to the coupler.

The frames each includes a partition provided between the two pairs of panels for defining the grooves and for receiving the edges of the plates. The latches of each pair of the latches of the coupler include a gap formed therebetween for receiving the partition of the frames.

The coupler includes three depressions formed between the latches, the corner area of each of the three plates includes two notches formed therein for defining a cusp, the cusps are received in the depressions of the coupler.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
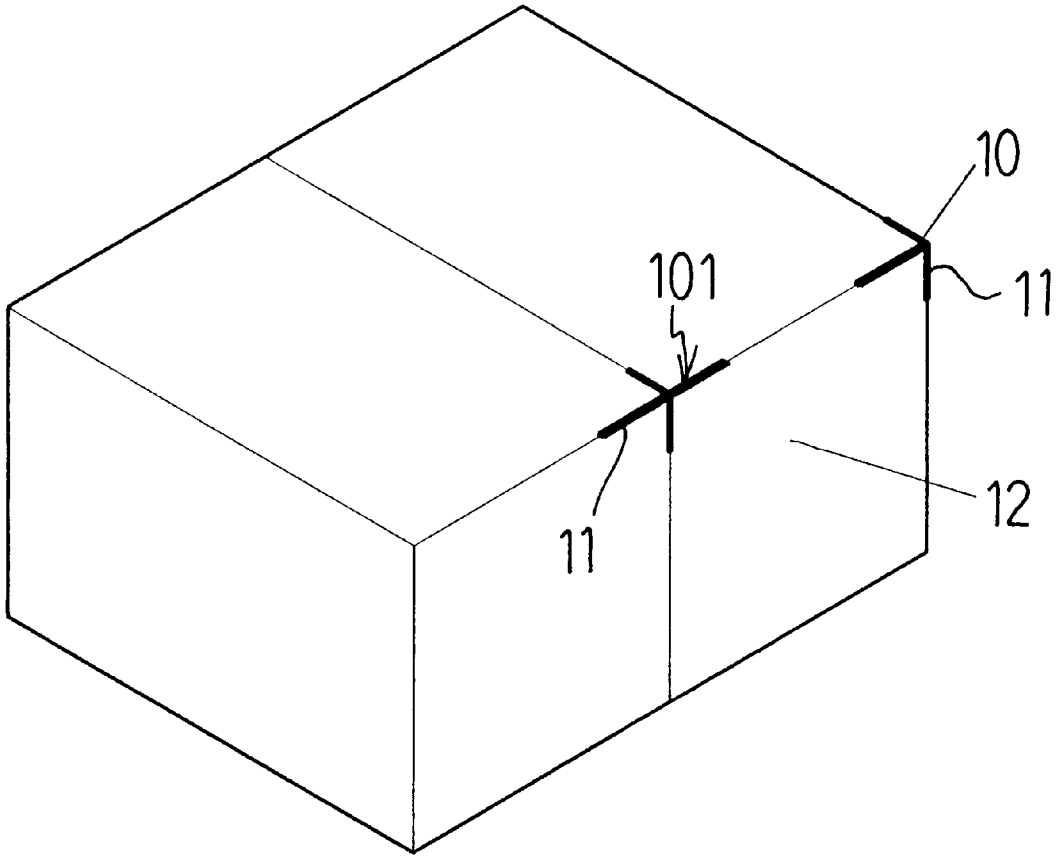
FIG. 1 is a perspective view of a box using one or more corner assemblies in accordance with the present invention.

Referring to the drawings, and initially to FIG. 1, a box in accordance with the present invention comprises three or more plates 12 secured together at a corner area with a coupler 10 and three or more frames 11. For example, the coupler 10 may couple three frames 11 together for securing the corner of the plates 12 together and another coupler 101 may couple four frames 11 together for securing the four plates 12 of two adjacent boxes together.

Figure 2:
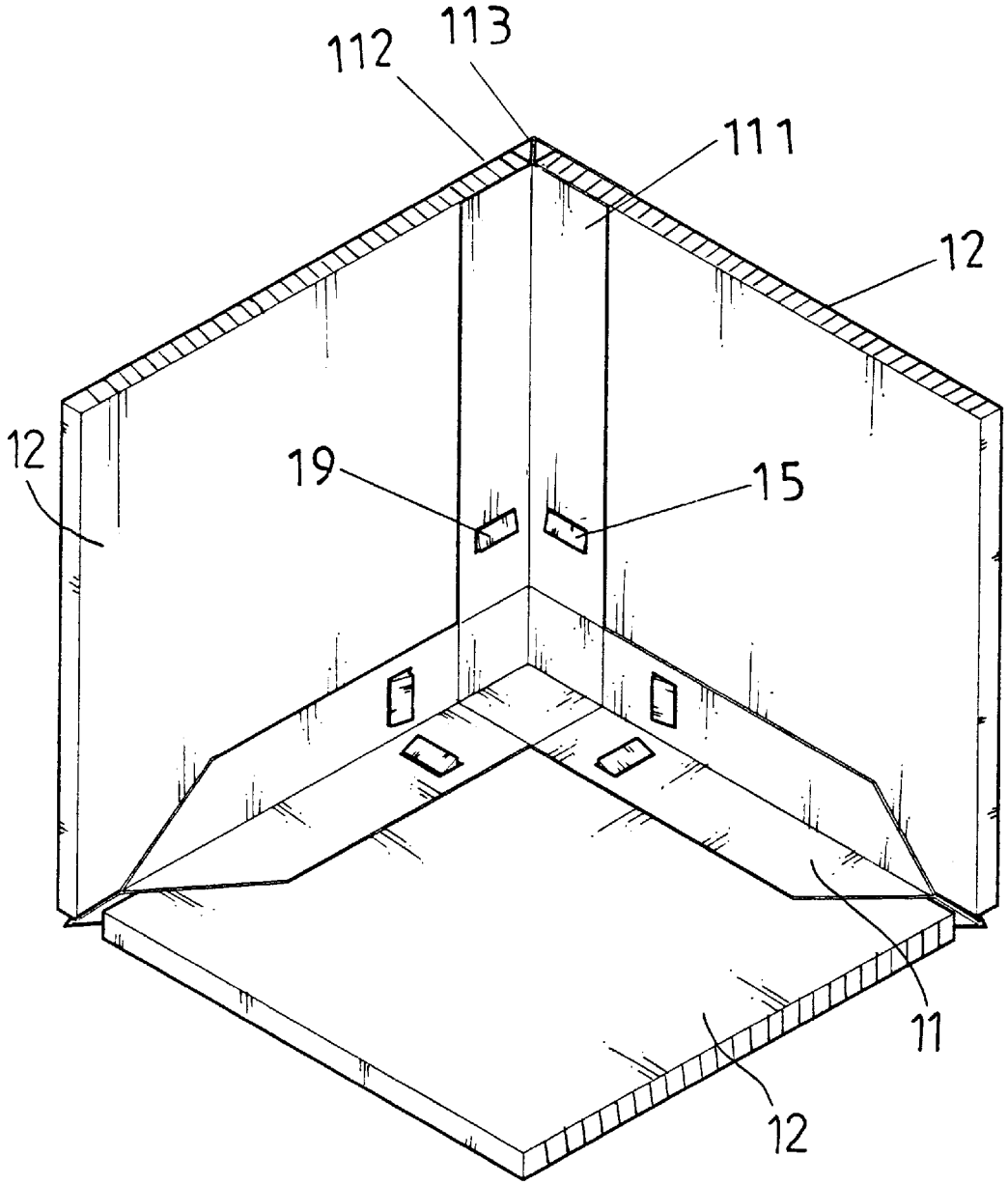
FIG. 2 is a perspective view of a corner of the box.
Figure 3:
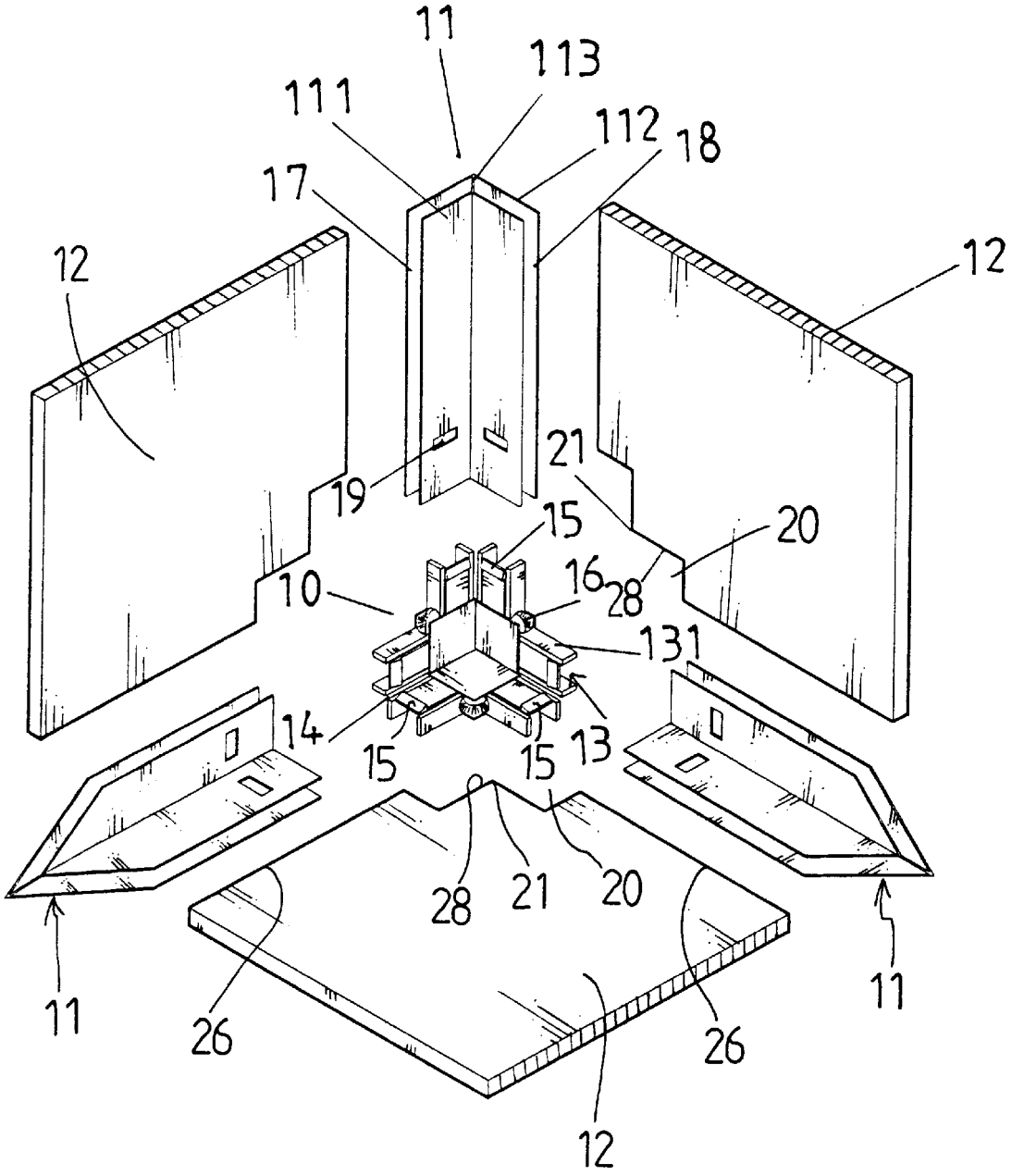
FIG. 3 is an exploded view of the corner of the box.
Figure 4:
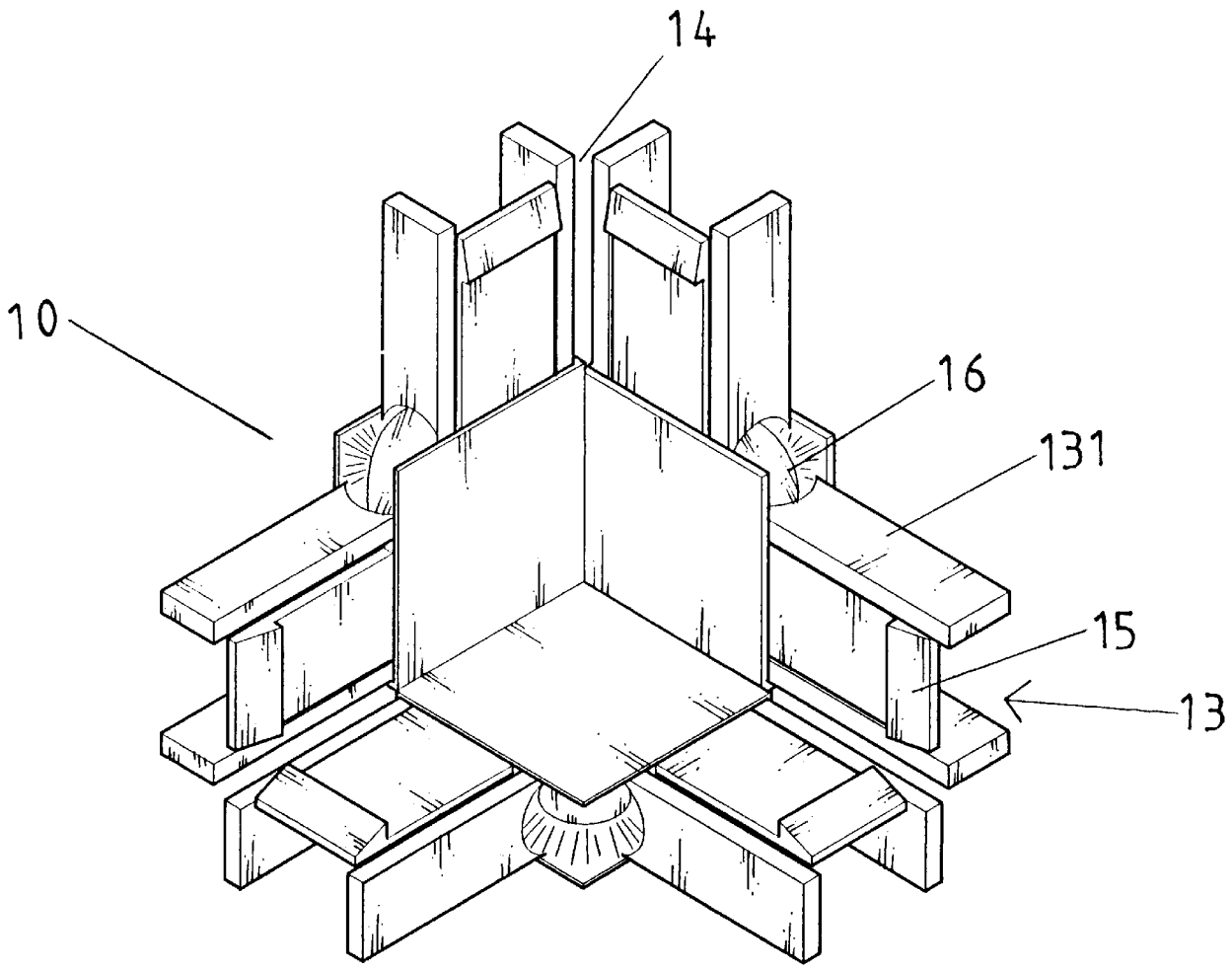
FIG. 4 is a perspective view illustrating the coupler of the corner assembly.

Referring next to FIGS. 2–4, the plates 12 each includes a corner area defined by two edges 26 and having two notches 20 formed therein for defining a cusp 21 and two surfaces 28 that are preferably perpendicular to each other. The coupler 10 includes three pairs of latches 13 each having two bars 131 and a hook 15 disposed between the bars 131. The two latches 13 of each pair of the latches 13 are preferably perpendicular to each other and include a gap 14 formed therebetween (FIG. 4). The coupler 10 includes three depressions 16 formed between the three pairs of latches 13 for receiving the cusps 21 of the plates 12. The surfaces 28 of the plates 12 are preferably engaged with the bars 131.

The frames 11 each includes two pairs of panels 111, 112 for defining two grooves 17, 18 which are perpendicular to each other and for receiving the edges 26 of the plates 12 and for receiving the pairs of latches 13 of the coupler 10. The frames 11 each includes a partition 113 disposed between the two pairs of panels 111, 112 for engaging into the gaps 14 defined between the pairs of latches 13 of the coupler 10. The inner panels 111 of each pair of the panels each includes an opening 19 formed therein for engaging with the hooks 15 and for securing the frames 11 to the coupler 10. The plates 12 may thus be solidly secured between the frames 11 and secured together by the coupler 10.

It is preferable that the plates 12, and the frames 11 and the couplers 10, 101 are made of fire proof materials. The elements 10, 101, 11, 12 may be easily and quickly assembled together without additional tools and fasteners. For a typical box having eight corners, eight couplers 10 and twenty four frames 11 are required for coupling six plates 12 together. The partition 113 may include a shorter length and may not be required to be engaged into the gaps 14 of the coupler 10.

Accordingly, the box in accordance with the present invention includes one or more corner assemblies for easily and quickly assembling one or more of the corners of the boxes together without additional tools and fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A box comprising:

at least three plates each including at least one corner area defined by two edges thereof, at least one coupler including three pairs of latches, at least three frames each including two pairs of panels for defining two grooves and for receiving said edges of said at least three plates and for receiving said pairs of latches of said at least one coupler, and means for securing said at least three frames to said at least one coupler and to secure said at least three plates together.

2. The box according to claim 1, wherein said latches of each pair of said latches of said at least one coupler are perpendicular to each other.

3. The box according to claim 1 , wherein said latches of said at least one coupler each includes two bars and a hook disposed between said bars, said pairs of panels of said at least three frames each includes an opening for engaging with said hooks and for securing said at least three frames to said at least one coupler.

4. The box according to claim 1, wherein said at least three frames each includes a partition provided between said two pairs of panels for defining said grooves and for receiving said edges of said at least three plates.

5. The box according to claim 4, wherein said latches of each pair of said latches of said at least one coupler include a gap formed therebetween for receiving said partition of said at least three frames.

6. The box according to claim 1, wherein said at least one coupler includes three depressions formed between said latches, said at least one corner area of each of said three plates includes two notches formed therein for defining a cusp, said cusps are received in said depressions of said at least one coupler.

* * * * *